United States Patent [19]

Johnson, Jr.

[11] Patent Number: 4,517,718

[45] Date of Patent: May 21, 1985

[54] CABLE CLAMPING AND ORIENTING APPARATUS

[75] Inventor: Keith Johnson, Jr., Manheim, Pa.

[73] Assignee: AMP Incorporated, Harrisburg, Pa.

[21] Appl. No.: 606,541

[22] Filed: May 3, 1984

Related U.S. Application Data

[63] Continuation of Ser. No. 298,132, Aug. 31, 1981, abandoned.

[51] Int. Cl.[3] ..... H01R 43/04

[52] U.S. Cl. ..... 29/33 M; 29/564.1; 29/748; 29/749

[58] Field of Search ..... 29/564.1, 56.6, 759, 29/749, 33 M, 566, 564, 760, 566.3, 748

[56] References Cited

U.S. PATENT DOCUMENTS

| | | | |
|---|---|---|---|
| 3,766,622 | 10/1973 | Brehm | 29/56.5 |
| 3,803,695 | 4/1974 | Tucci | 29/749 |
| 3,965,558 | 6/1976 | McKee | 29/749 |
| 3,968,555 | 7/1976 | Holt | 29/749 X |
| 3,995,358 | 12/1976 | Long et al. | 29/203 MW |
| 4,006,519 | 2/1977 | Long et al. | 29/749 |
| 4,034,472 | 7/1977 | Cover et al. | 29/749 |
| 4,193,187 | 3/1980 | Haller et al. | 29/749 |
| 4,238,874 | 12/1980 | Chandler et al. | 29/33 M |
| 4,288,908 | 9/1981 | Hatfield | 29/564.1 |

*Primary Examiner*—William R. Briggs
*Attorney, Agent, or Firm*—F. Brice Faller

[57] ABSTRACT

Clamp for use with an apparatus which connects insulated wires of an electrical cable to a multi-row electrical connector by incrementally moving a connector holder relative to a stationary wire insertion mechanism. The clamp is pivotably linked by a pair of arms to one end of a slide which has a holder for the electrical connector at the other end, so that incremental movement of the holder causes corresponding incremental movement of the clamp. The clamp position is adjustable to orient the cable either perpendicular or parallel to the direction of movement of connector holder, and the clamp moves either perpendicular or parallel to the direction of movement, so that the cable projects either perpendicular or parallel to the connector when all the wires are connected.

9 Claims, 14 Drawing Figures

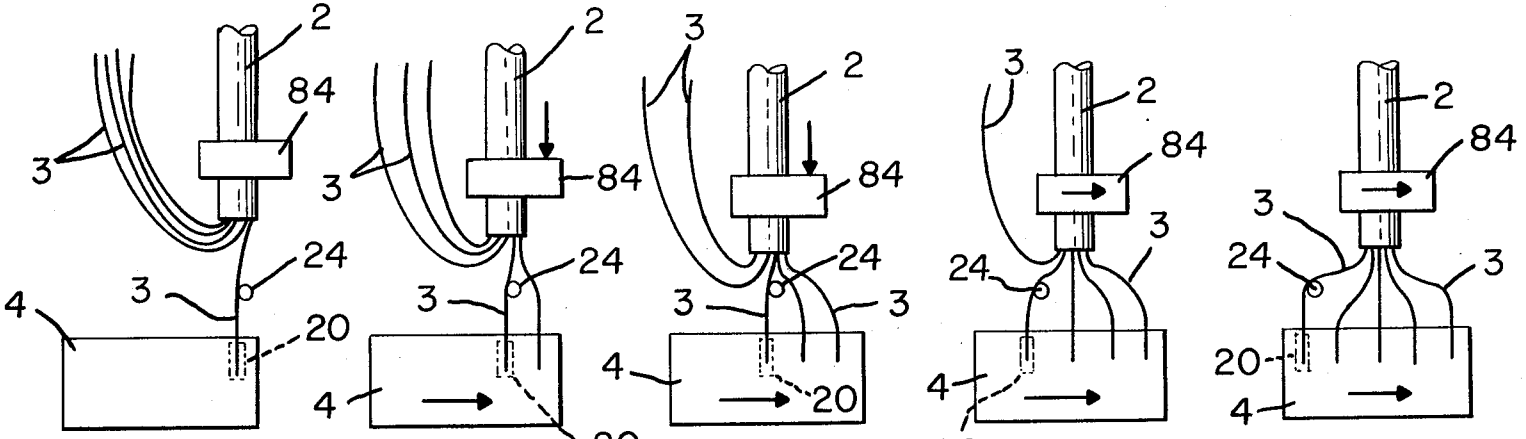
Fig. 7A
Fig. 7B
Fig. 7C
Fig. 7D
Fig. 7E
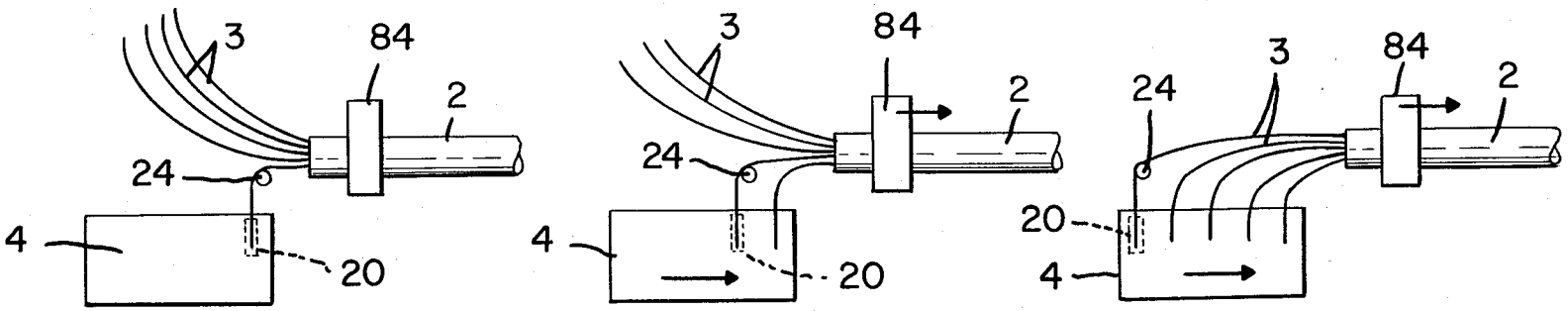
Fig. 8A
Fig. 8B
Fig. 8C

CABLE CLAMPING AND ORIENTING APPARATUS

This application is a continuation of application Ser. No. 298,132 filed Aug. 31, 1981, abandoned.

BACKGROUND OF THE INVENTION

1. Field of the Invention

The present invention relates to termination of insulated wires of a multiwire cable to an electrical connector. Apparatus is disclosed which orients the cable relative to the connector during termination so that the cable will project at a right angle to the connector when all of the wires are terminated.

2. Description of the Prior Art

An electrical connector for terminating multiple conductor electrical cable is disclosed in U.S. Pat. No. 3,760,335, and includes two parallel rows of electrical contacts. A similar connector is disclosed in U.S. Pat. No. 4,243,288. The contacts of a plug version of the connector resiliently engage those of a receptacle version, when the two versions are intermated. The contacts of each version have wire receiving and connecting portions, each in the form of a resilient plate provided with a slot. An insulated conductor of the cable is trimmed to length and inserted in the slot. The conductor tends to widen the slot. Since the plate is resilient, the sides of the slot provide resilient jaws which resist widening of the slot. As a result, the jaws slice through the insulation of the conductor and resiliently engage opposite sides of the wire.

Suitable apparatus employing wire insertion tooling have been developed for trimming and inserting the conductors into the connector contacts, each requiring an operator to grasp a pair of conductors and insert them into the apparatus. Then the insertion tooling is actuated, either manually or automatically, to trim the conductor and transfer the trimmed wires into the connector. One type of apparatus, disclosed in U.S. Pat. Nos. 3,803,695 and 3,864,802, requires all conductor pairs to be placed in the apparatus, followed by simultaneous or mass termination of the conductors in the connector contacts. A second type, disclosed in U.S. Pat. Nos. 3,766,622 and 3,995,358, and sold by AMP Incorporated of Harrisburg, Pa., under the name CHAMP-O-MATIC, senses each pair of conductors and thereby is automatically triggered to trim and insert the pair into a corresponding pair of connector contacts. While an operator is in the process of selecting and grasping the next pair of conductors, the apparatus of the second type automatically moves the connector relative to the insertion tooling so that the next pair of contacts are adjacent the tooling and therefore positioned for insertion of the next pair of conductors. For another example of the second type, see U.S. Pat. No. 4,034,472. A third type of apparatus, disclosed in U.S. Pat. No. 4,238,874 and sold by AMP Incorporated under the name CHAMP-O-MATOR, is also semi-automatic but employs insertion tooling on a carriage movable relative to a stationary connector. For another example of the third type, see U.S. Pat. No. 3,968,555.

Each type of conductor trimming and inserting apparatus requires a clamp for anchoring the cable to the apparatus while the conductor terminations occur. The clamp is positioned out of the way of the operator and the working parts of the apparatus. While this clamp location is convenient to the operation of the apparatus, the clamp may force the cable to project in a peculiar or undesired direction in respect to the connector to which it becomes assembled.

In U.S. Pat. No. 3,995,358 the clamp is stationary relative to the connector and is useful only for a cable aligned in parallel with the connector. In U.S. Pat. No. 4,238,874 the clamp is stationary relative to the movable insertion tooling and likewise is useful only for a cable aligned in parallel with the connector. U.S. Pat. No. 4,288,908 discloses a cable clamping and orienting apparatus, for use with the latter type wire insertion apparatus, which moves relative to the stationary connector and the insertion tooling so that the cable may be oriented at a right angle to the connector. The problem of providing a clamping apparatus to permit this desired orientation in wire insertion apparatus of the type disclosed in U.S. Pat. Nos. 3,766,622 and 3,995,358 has not heretofore been solved.

SUMMARY OF THE INVENTION

The present invention resides in a cable clamping and orienting apparatus for use with wire insertion apparatus of the type disclosed in U.S. Pat. Nos. 3,766,622 and 3,995,358. The invention may also be used in a fully manually operated bench tool as herein disclosed, as the principle of having the connector undergo indexed traverse relative to stationary insertion tooling is the same. The cable clamp orients the cable perpendicularly to the connector and is linked to the connector holder so that the clamp undergoes only vertical movement during initial movement of the connector, until wires are terminated to the midway point of the connector. The clamp then moves parallel to the movement of the connector and remains stationary relative thereto so that the cable is ultimately at a right angle to the connector proximate the midpoint thereof with the individual wires fanned out toward the ends of the connector. The position of the clamp vis-a-vis the connector holder is adjustable so that the cable is held parallel to the connector and is further adjustable so that the vertical movement of the clamp is eliminated. In this second or parallel mode, the parallel orientation of the cable to the connector as in the prior art is possible.

It is thus an object of the present invention to provide a wire trimming and inserting apparatus with a cable clamp which orients the cable to a desired position while the conductors of the cable are being trimmed and inserted into an electrical connector.

It is another object of the invention to provide linkage between the clamp and the connector holder so that incremental indexed movement of holder results in corresponding incremental indexed movement of the cable clamp, thus eliminating the need for a separate drive to move the clamp.

Another object is to provide adjustable mounting of the clamp so that its orientation may be changed, thus changing the orientation of the cable relative to the connector.

Yet another object is to provide adjustments in the linkage so that the cable can be held stationary relative to the connector during wire insertion to achieve the parallel or longitudinal orientation of cable to connector as in the prior art.

These and other objects and advantages of the invention will be apparent from the following detailed description taken in conjunction with the accompanying drawings.

BRIEF DESCRIPTION OF THE DRAWINGS

FIG. 7A et seq show the operational sequence for a perpendicularly terminated cable.

FIG. 8A et seq show the operational sequence for a longitudinally terminated cable.

DETAILED DESCRIPTION OF THE PREFERRED EMBODIMENT

Figures 1, 2, 3:
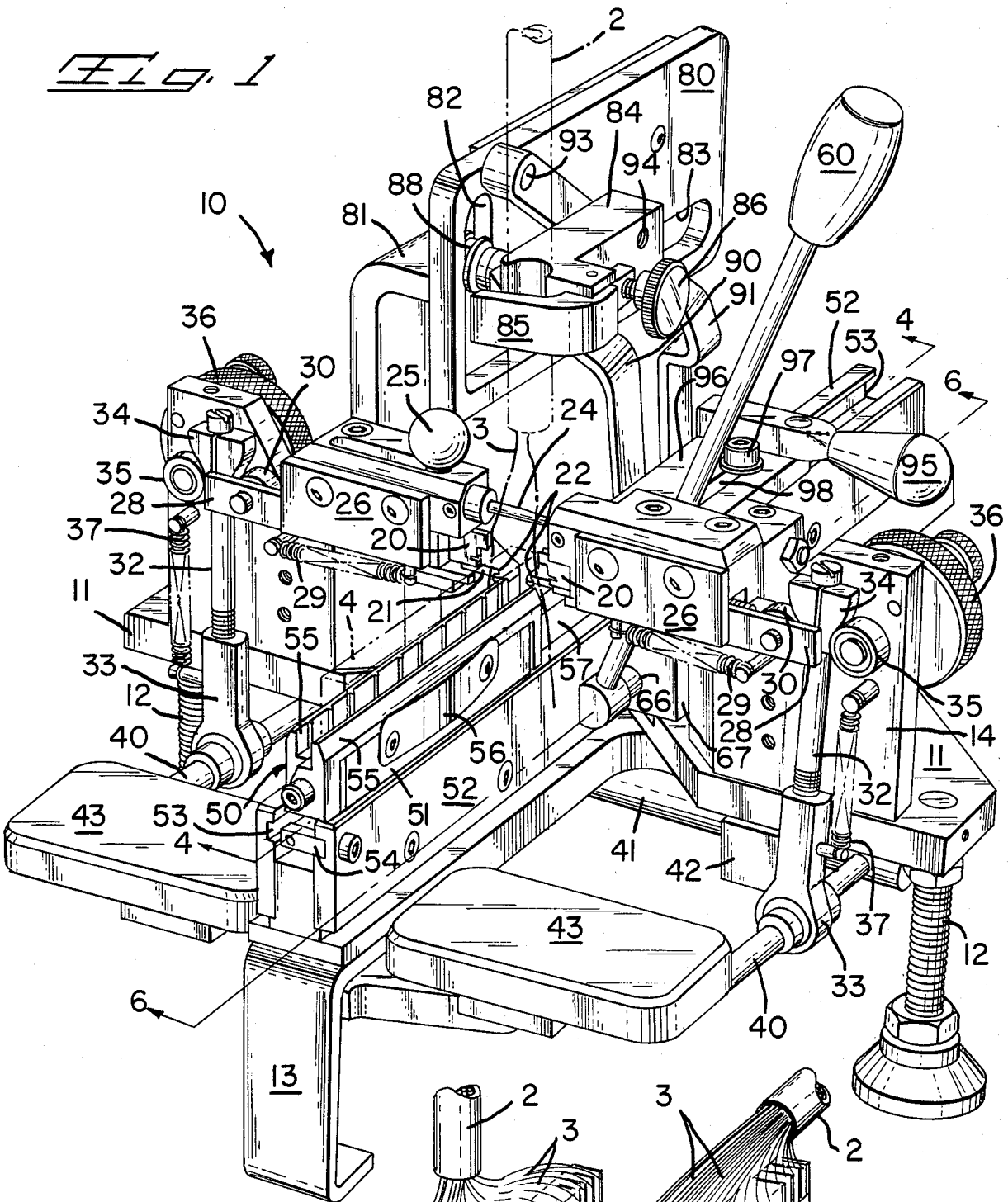
FIG. 1 is a perspective of the clamp as used on a manual wire insertion apparatus.
FIG. 2 is a perspective of a perpendicularly terminated cable.
FIG. 3 is a perspective of a parallelly terminated cable.

FIG. 1 shows the cable clamp and orienting apparatus of the present invention as utilized on a manually operated wire insertion apparatus 10. The apparatus 10 is a bench device fixed to a frame 11 which sits on legs 12, 13. Salient features of the apparatus 10 include opposed insertion tooling 20, each employing two insertion blades and a shear blade 21 as generally disclosed in U.S. Pat. No. 3,968,555. Each shear blade 21 is profiled with an aligning slot 22 which together with dresser bar 24 provides means for manually aligning each pair of wires 3 of the cable 2 with terminals in opposed sides of an elongate connector. The dresser bar 24 is retractable by spring loaded return handle 25 which is carried in housing 26 with the insertion tooling 20. The insertion tooling 20 is actuated by depressing handles 43 which act in unison to pivot levers 40 about pivot shaft 41 which is carried in journal boxes 42 underneath the frame 11. The levers 40 are attached to rods 32 by ball joints 33; downward movement of each lever 40 thus draws the cam 34 at the upper end of the rod 32 between the eccentric 35 and wheel 30 carried on the end of slide 28 to push each insertion tooling 20 toward the other. The eccentric 35 is rotated and locked by adjusting wheel 36 to adjust the travel of tooling 20 so that precise wire insertion and crimping in the terminals of the connector may be attained. The tooling is returned by the action of return spring 29 mounted on the slide 28 at one end and the upright frame member 14 at the other end, and return spring 37 mounted between the rod 32 at one end and the frame member 14 at the other.

Referring still to FIG. 1, the connector holder 50 comprises a pair of opposed jaws 55 pivotably mounted to carriage 51 and urged toward each other by leaf springs 56 bolted to the carriage 51. The carriage 51 is integral with an elongate slide 57 which is profiled to ride in channels 53 in slide track 52 and is limited in travel by adjustable stop 54. The slide 57 has a yoke 96 mounted at its opposite end by screw 97 which passes through slot 98 so that the position of the yoke 96 on the slide 57 can be adjusted. The yoke 96 has a handle 95 thereon for moving the slide 57 in slide track 52 while simultaneously moving the link arms 90, 91. First link arm 90 and second link arm 91 are pivotably mounted to the side of the yoke 96 and pivotably mounted to cable clamp 84 at the other end of the link arms so that longitudinal movement of the slide 57 causes the clamp 84 to move relative to cam plate 80. The cam plate 80 is fixed relative to frame 11 by bracket 81 and has vertical slot 82 and horizontal slot 83 machined therein. The slots 82, 83 intersect to form an L-shaped guide track which directs the movement of clamp 84 by means of follower 88 bolted on the side of clamp 84. The same bolt which carries the follower also provides pivotal connection between the first link arm 90 and the clamp 84, which is further pivotably connected to second link arm 91 by a bolt passing through a hole 92 (visible in FIG. 6) in the link arm 91 and into a tapped bore 94 in the clamp 84. The clamp orientation may be changed by removing this bolt and passing it through hole 93, as will be explained hereinafter. The clamp 84 is cooperative with finger 85 and clamping screw 86 to grip a cable being terminated. The connector holder 50 and likewise the clamp 84 are moved incrementally by indexing handle 60 which will also be discussed hereinafter.

Referring briefly to FIGS. 2 and 3, a perpendicular or "right dress" orientation between the cable 2 and connector 4 is shown in FIG. 2. A longitudinal or "parallel dress" orientation between cable 2 and connector 4 is shown in FIG. 3. The clamping and orienting apparatus of the present invention enables either configuration to be completed neatly, and for a variety of connector lengths.

Figure 4:
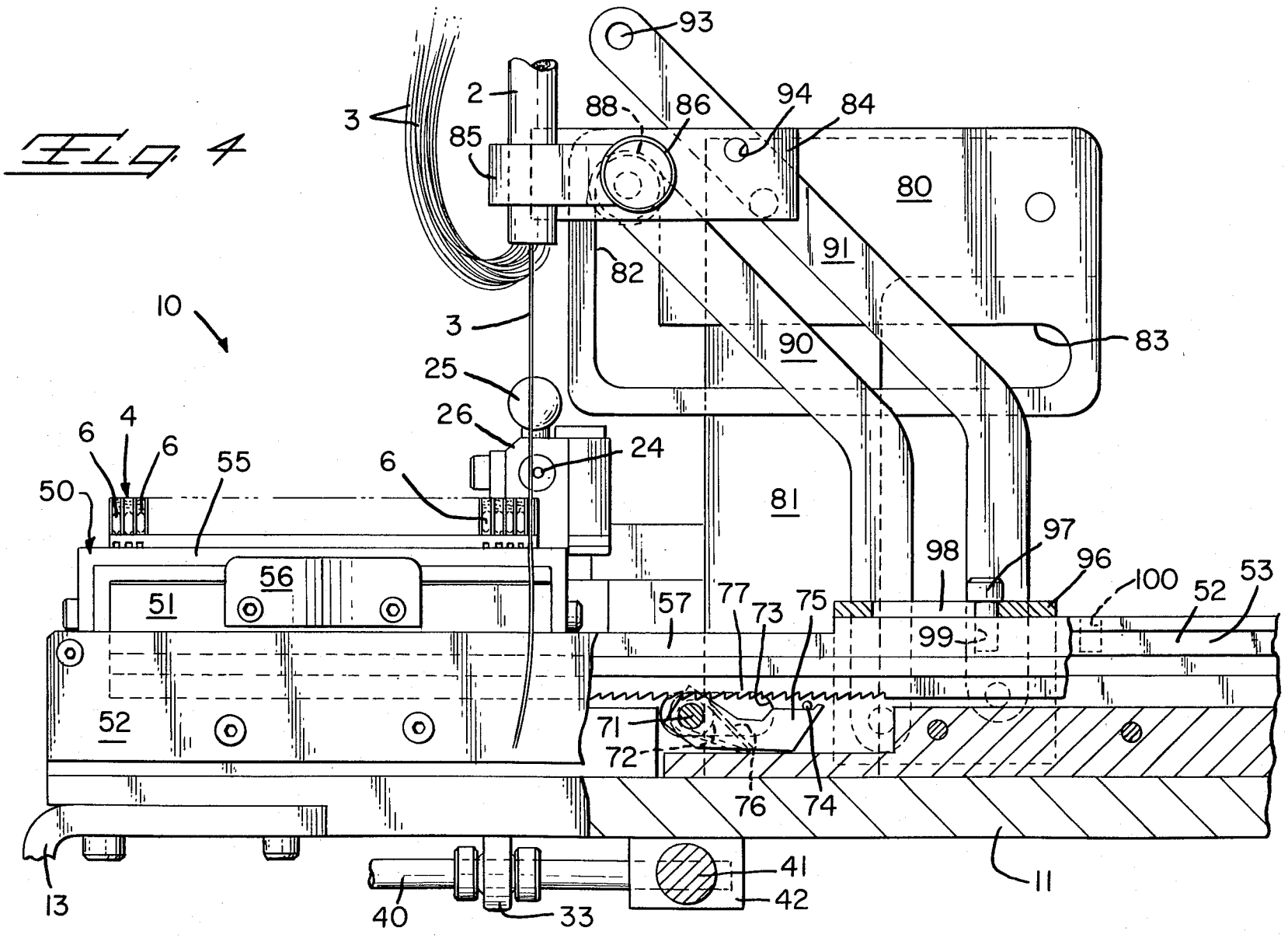
FIG. 4 is a side sectional view of the apparatus at the beginning of the sequence for perpendicular cable termination.
Figure 5:
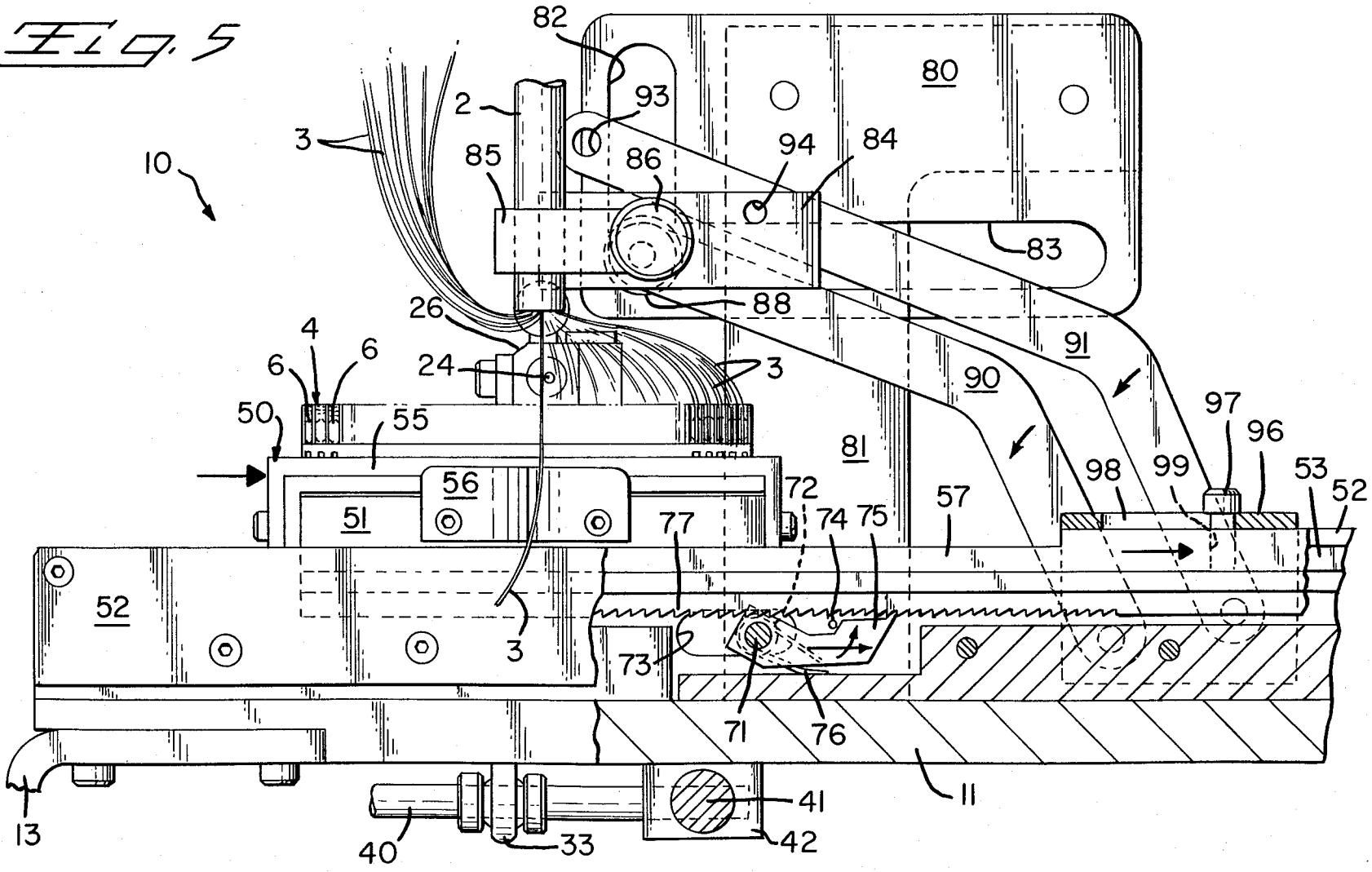
FIG. 5 is a side sectional view of the apparatus midway through the sequence for perpendicular cable termination.

FIG. 4 depicts the initial position of the clamp 84, yoke 96, and connector holder 50 required to achieve perpendicular orientation of a cable 2 when all wires 3 are connected to a connector 4 having 36 terminals in each side (FIG. 2). The position of follower 88 in vertical slot 82 is adjusted so that the follower 88 will be at the bottom of slot 82 when the holder 52 has travelled until the connector has wires terminated to its midpoint, as shown in FIG. 5. This adjustment is effected by loosening screw 97, which passed through slot 98 and into threaded bore 99, and moving yoke 96 relative to slide 57. Additional adjustment is possible by moving removing screw 97 from threaded bore 99 in slide 57 and moving the yoke 96 so that screw 97 may be received through slot 98 and into bore 100. The initial position of the follower 88 in slot 82 is determined by the length of connector 4; a long connector as shown in FIG. 4 will necessitate starting the follower 88 higher in slot 82. The wire 3 to be terminated is drawn down against dresser bar 24 so that it is between the insertion tooling 20 (see FIG. 1). Following wire insertion, the dresser bar 24 is retracted into housing 26 by bearing on handle 25 and then indexing the holder 50 before releasing handle 25. The next pair of terminals 6 is thus in position for wire insertion, and the clamp 84 is indexed down so that wires already terminated will be behind the dresser bar 24. Indexing is effected by pawl 75 and rack 77 on the bottom of slide 57. The pawl 75 is pivotably mounted on pivot shaft 71 and is urged against peg 74 by spring 76; stability is achieved by follower 72 on shaft 71 which rides through slot 73 in the slide track 52. The peg 74 is mounted in inside sidewall of slide track 52; the pawl is movable linearly relative to the peg 74.

FIG. 5 depicts the position of the clamp 84, yoke 96, and connector holder 50 as the eighteenth pair of wires is positioned for termination to a 36-pair connector. The pawl 75 is shown as it bears on rack 77 to advance slide 57; the pivot shaft 71 has moved the pawl 75 linearly relative to the rack 77 until the spring 76 urges the pawl against the rack 77 and causes it to incrementally advance. Note that since follower 88 is in the bottom of vertical slot 82, additional movement will be limited to the confines of horizontal slot 83. The cable 2 is thus held stationary relative to the connector 4 while the remaining wires 3 are inserted in terminals 6, the dresser bar 24 being retracted prior to each indexed movement so that slightly longer wires are being inserted with each insertion.

Figure 6:
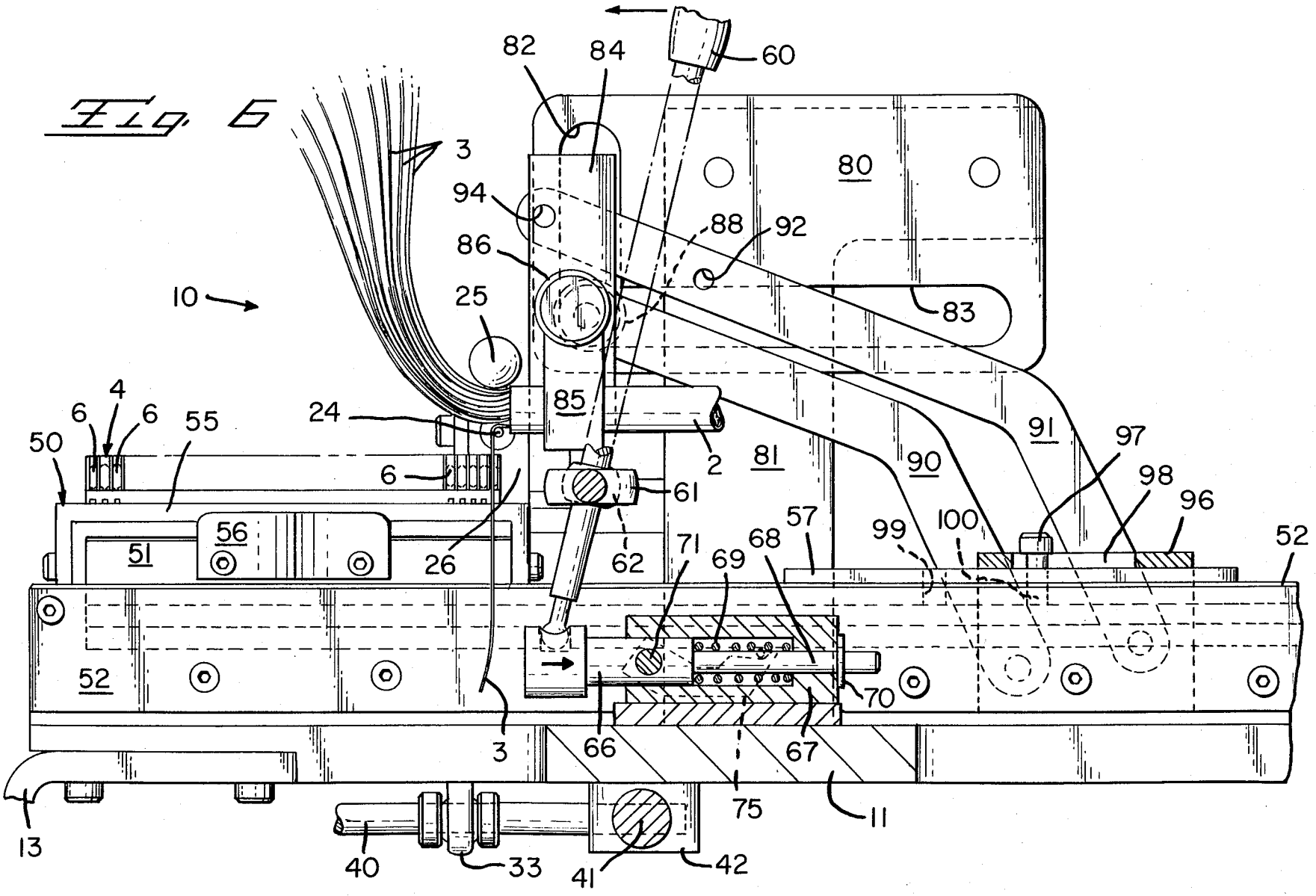
FIG. 6 is a side sectional view of the apparatus at the beginning of the sequence for longitudinal cable termination.

FIG. 6 depicts the initial position of the clamp 84, yoke 96, and connector holder 50 required to achieve parallel orientation of a cable 2 when all wires 3 are connected to a connector 4 having 36 terminals in each side (FIG. 3). The clamp 84 has undergone a 90-degree re-orientation from the position of FIGS. 5 and 6 so that the cable 2 is held parallel to the connector 4; this is accomplished by fixing the clamp 84 to the second link arm 91 by passing a screw through smooth bore 93 into the tapped bore 94 in the clamp. The yoke 96 is positioned relative to slide 57 so that follower 88 is at the leftward or forward end of horizontal slot 83. The clamp 84 thus remains stationary relative to the connector 4 as successively longer pairs of wires 3 are drawn from the cable 4 for each wire insertion procedure. The indexing handle 60 is shown prior to indexing. The handle 60 has a ball 62 thereon which is carried in fixed socket 61 so that pivoting handle 60 forward at the top causes the bottom to bear against indexing shaft 66 as shown. The shaft 66, which carries pivot shaft 71, thus moves through cylinder 67 against the resilient force of spring 69. The rod 68 passes through a bore in the end of cylinder 67 and carries a stop clip 70 outside the cylinder which limits travel of the indexing shaft 66 on the return stroke. Note that the position of the pivot shaft 71 in FIG. 6 corresponds to that in FIG. 4.

FIGS. 7A et seq schematically summarize the movements in the apparatus to terminate a cable 2 to a connector 4 perpendicularly, as shown in FIG. 2. FIG. 7A is similar to FIG. 4, showing the clamp 2 fully upward as the first pair of wires 3 are positioned against the dresser bar 24 for insertion in connector 4. FIG. 7B shows the clamp 84 partially downward as the connector 4 is moved right relative to the dresser bar 24 (and the insertion tooling) to insert a pair of wires 3 midway between the starting end and the midpoint of the connector. FIG. 7C is similar to FIG. 5, showing the clamp 84 fully downward as a pair of wires 3 are addressed to terminals at the midpoint of the connector 4, which has again moved to the right. FIG. 7D shows the clamp 84 partially rightward as a pair of wires is inserted midway between the midpoint of the connector 4 and the concluding end. FIG. 7E shows the clamp 84 and connector 4 moved fully rightward relative to the dresser bar 24 (and insertion tooling) as the wires 3 are positioned for the final insertion operation. In each step, the order of operations is: (a) position wires for termination; (b) insert; (c) retract dresser bar; (d) index; and (e) return dresser bar. When the terminations to the connector are complete, the yoke is returned by bearing on handle 95 (FIG. 1). This action returns the connector holder 50 and cable clamp 84 to their initial positions. The finger 85 is then released so that the cable 2 and connector 4 can be removed and another connector and cable placed for termination.

FIGS. 8A et seq schematically summarize the movements in the apparatus to terminate a cable 2 to a connector 4 longitudinally, as shown in FIG. 3. FIG. 8A corresponds to FIG. 6, and FIGS. 8B and 8C show additional steps as the clamp 84 and connector 4 remain stationary relative to each other and move relative to the dresser bar 24 (and the insertion tooling).

The above described embodiment is exemplary and not intended to limit the scope of the claims which follow.

What is claimed is:

1. Apparatus for inserting wires into the wire-receiving portions of terminals in an electrical connector, said connector being of the type having said wire-receiving portions arranged in a row which extends from one end of the connector to the other end thereof, said machine having a stationary frame, insertion tooling in said frame which is reciprocable along a first path, a carriage in said frame which is reciprocable along a second path which extends normally of said first path, connector holding means on said carriage for holding said connector, indexing means for indexed movement of said holder on said second path through said tooling, and a cable clamp for clamping a cable containing wires which are to be connected to terminals, said apparatus being characterized in that:

said cable clamp is movable relative to said insertion tooling from an initial position to a final position, said clamp being in alignment with and spaced from said tooling in said initial position and spaced from a connector in said holding means, said clamp being proximate to said connector in said final position and displaced along said second path from said insertion tooling, cam means and linkage for moving said clamp during indexing of said connector, said cam means comprising a cam follower carried by said clamp and interengaged with a guide cam effective to move said clamp towards said connector during insertion of the wires to the terminals between one end of said row and a midpoint thereof, and being effective to move said clamp parallel to said connector during insertion of the wires to the terminals between said midpoint and the other end of said row, said linkage comprising a first link arm between said clamp and said carriage, said link arm being pivotally connected to said clamp and pivotally connected to said carriage.

2. Apparatus comprising stationary wire insertion tooling, indexing means, a holder for an electrical connector linked to said indexing means for indexed traverse of said connector with respect to said insertion tooling and for successive indexed alignment of the terminals of said connector with said insertion tooling, said wire insertion tooling being operative for connecting individual wires with respective said terminals, and a cable clamp movable with respect to said insertion tooling for clamping a multiple wire cable during connection of the individual wires thereof with said terminals, said clamp carrying a cam follower interengaged with a guide cam which limits said clamp to movement transversely and longitudinally of the direction of movement of said connector during said indexed traverse of said connector with respect to said insertion tooling.

3. Apparatus as recited in claim 2, characterized in that said clamp is pivotally connected to a first link arm, and a pivotal connection is provided between said first link arm and said holder for said electrical connector.

4. Apparatus as recited in claim 2, characterized in that said guide cam comprises a transverse section for indexed traverse of said cam follower and said clamp transversely of said connector holder and a longitudinal section for indexed traverse of said cam follower and said clamp longitudinally of said traverse of said connector holder, one end of said transverse section being continuous with one end of said longitudinal section, whereby said clamp can be moved transversely and longitudinally of said traverse of said connector holder.

5. Apparatus as recited in claim 3, characterized in that said holder is mounted on an elongate slide proximate one end thereof, said first link arm being pivotally connected to a yoke mounted on said slide proximate the other end thereof.

6. Apparatus as recited in claim 5, characterized in that said indexing means is operative on said slide.

7. Apparatus as recited in claim 5, characterized in that said clamp and cam follower are pivotally mounted on a second link arm, said second link arm being pivotally connected to said yoke.

8. Apparatus as recited in claim 7, characterized in that said clamp and cam follower are pivotally mountable to said second link arm in either of two positions, whereby two orientations of said clamp relative to said holder are possible.

9. Apparatus as recited in claim 5, characterized in that said yoke is mountable to said slide in a plurality of positions along the length thereof proximate the end thereof, whereby the position of said clamp and said cam follower along said guide cam is adjustable independently of said indexing means.

* * * * *